United States Patent [19]

Brueske

[11] Patent Number: 4,644,329

[45] Date of Patent: Feb. 17, 1987

[54] EDGE OF ROOF PERIMETER WORKMAN SAFETY LIGHT DEVICE

[75] Inventor: Ralph H. Brueske, Kansas City, Mo.

[73] Assignee: Butler Manufacturing Company, Kansas city, Mo.

[21] Appl. No.: 593,842

[22] Filed: Mar. 27, 1984

[51] Int. Cl.[4] ..... G08B 13/18

[52] U.S. Cl. ..... 340/556; 182/112

[58] Field of Search ..... 340/556, 557, 693, 635, 340/552, 553, 554, 555; 250/239; 248/237, 231.7, 231.4, 228; 182/112, 45

[56] References Cited

U.S. PATENT DOCUMENTS

| | | | |
|---|---|---|---|
| 2,999,290 | 9/1961 | Giles | 182/107 X |
| 3,217,833 | 11/1965 | Smith | 248/228 |
| 3,881,698 | 5/1975 | Marsh | 248/231.4 X |
| 4,171,032 | 10/1979 | Woodslayer et al. | 248/228 |
| 4,186,388 | 1/1980 | Robinson | 340/323 R X |
| 4,408,195 | 10/1983 | Tullis et al. | 340/540 X |

*Primary Examiner*—James L. Rowland

*Assistant Examiner*—Jeffery A. Hofsass

*Attorney, Agent, or Firm*—Shoemaker and Mattare, Ltd.

[57] ABSTRACT

A workmen protecting safety light for roof perimeter edge protection includes a pair of invisible light beam units, one bearing a light beam source and the other being a light beam receiver/control, and a relay box together with audio warning and signalling apparatus. Supporting structure includes a base support frame, a sub-base, tripod support, vertically and horizontally adjustable support pipes and clamping structures. All the foregoing are combined to provide an easily, quickly and accurately installed perimeter safety light protection device. A plurality of specially sized and marked pipes, support brackets for the light units, and specific adjusting/clamping structures are all important features of the invention. Preferably, the units are supplied in kit form and, therefore, suitable containers are provided for holding same in compact, easily shippable and stored form, ready for quick and easy assembly at a job site.

18 Claims, 8 Drawing Figures

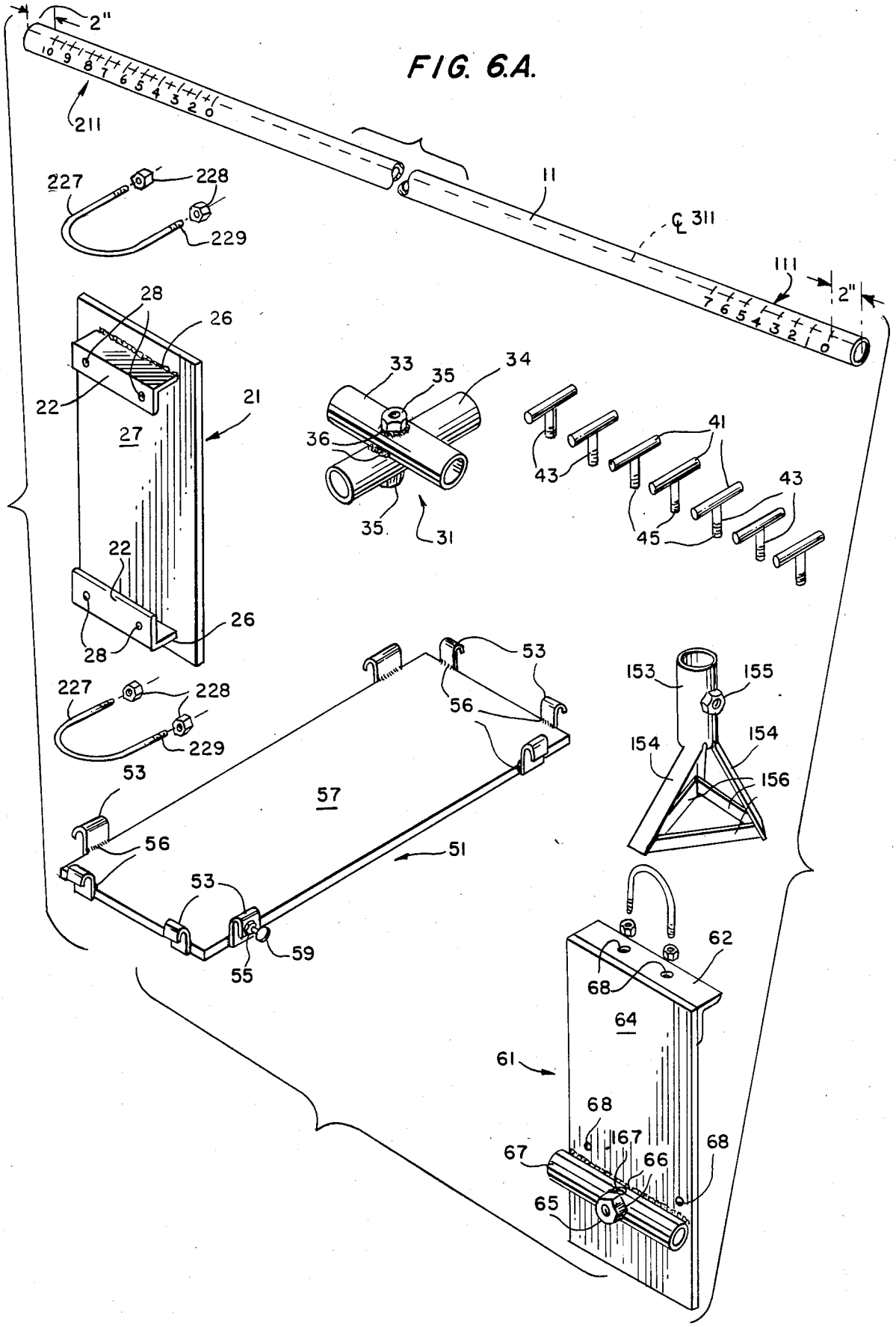
FIG. 6.A.
2"
211
11
℄ 311
111
2"
227
228
229
28
26
22
21
27
33
35
34
36
35
31
41
43
43
45
22
26
28
227
228
229
53
56
53
56
57
51
53
59
55
153
155
154
154
156
62
68
64
61
68
167
67
66
68
65

FIG. 6.B.
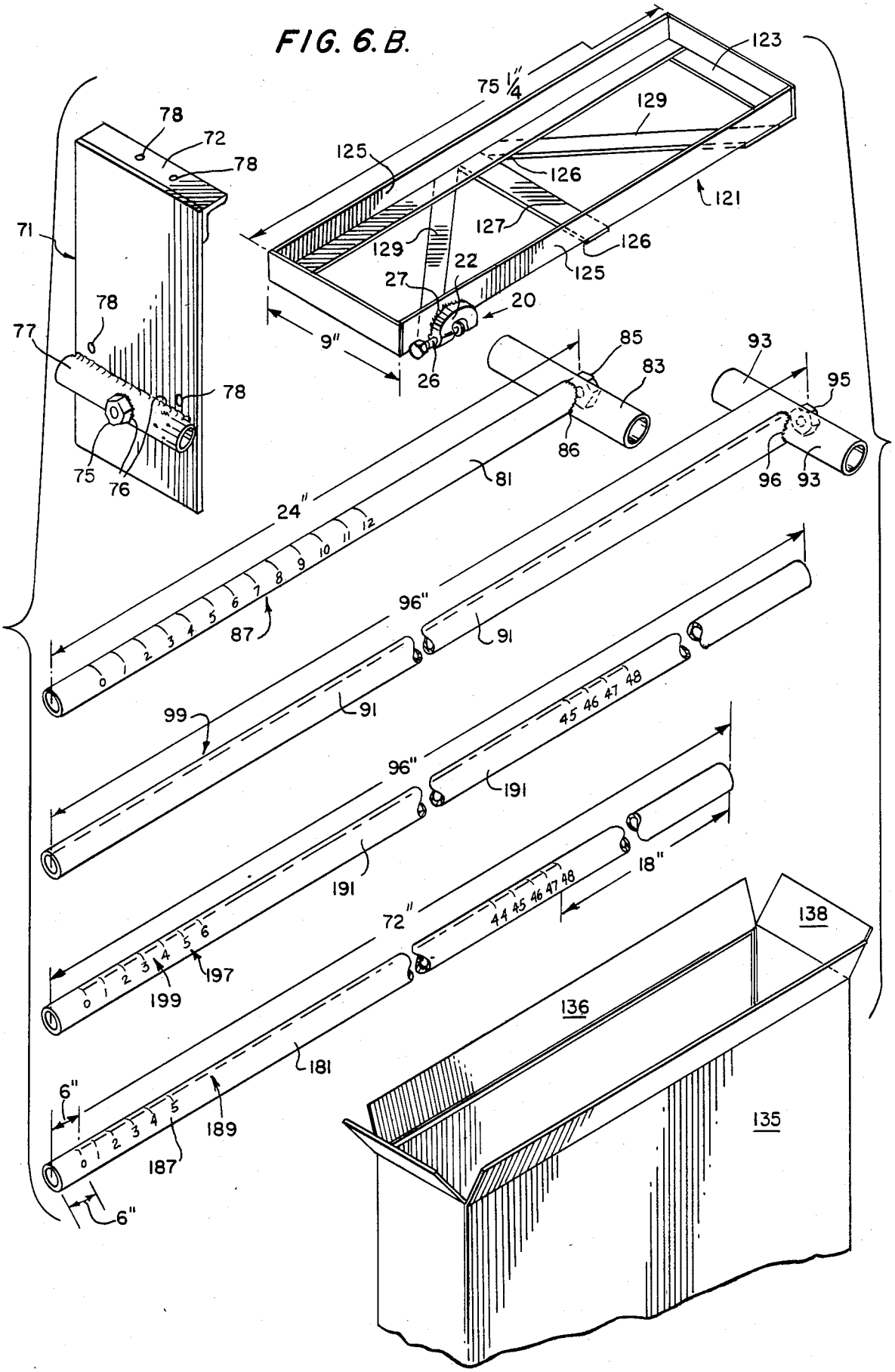

EDGE OF ROOF PERIMETER WORKMAN SAFETY LIGHT DEVICE

BACKGROUND OF THE INVENTION

1. Field of the Invention

This invention relates generally to safety devices for warning persons working upon a roof that they are getting dangerously close to an edge of same.

2. Description of the Prior Art

It is a safety requirement that workmen working on a roof, either applying a new roof system or repairing or remodeling an old roof system, be protected from falling from the roof perimeter.

Several methods are commonly used to protect a workman from falling off the roof perimeter. One is to place a safety line to which the workman can fasten to while working on the roof, and another is to provide a warning line to remind the workman that he is near the roof perimeter.

One method used today on pre-engineered building roof panel placement for the edge of the roof workman protection is a rope or chain marked with colorful banners which is a warning line to remind the workman of the roof edge. Although the line is helpful as a reminder, the line is constantly in the workman's way while applying roof material, which is a great disadvantage.

Also, it is known in the art to utilize beams of light, including lasers, to act as safety or protection devices in association with areas to be guarded; however, the inventor is not aware of any art utilizing such a concept for a safety device in conjunction with the perimeter of a building roof, and especially with structure which can be attached to the existing sections of a roof, the roof panel support purlins, the end sections and edges of the roof, and the like.

Existing prior patents which may be pertinent to the present invention are as follows:

U.S. Pat. No. 3,623,057—R. A. Hedin, et al.—11/23/71

U.S. Pat. No. 3,653,021—C. Litman, et al.—3/28/72

U.S. Pat. No. 3,825,916—R. K. Steele, et al.—7/23/74

U.S. Pat. No. 4,004,805—K. Chen, et al.—1/25/77

U.S. Pat. No. 4,186,388—D. W. Robinson—1/29/80

U.S. Pat. No. 4,408,195—B. J. Tullis, et al.—10/04/83.

U.S. Pat. No. 3,623,057 to Hedin, et al. discloses the use of laser beam apparatus for protecting the perimeter of a predetermined geographical area. However, this device is mounted upon the ground or similar floor surface, and fails to provide any structure whatsoever for use of same with the roof of a building being constructed and/or repaired.

The patent to Litman, et al., U.S. Pat. No. 3,653,021, shows apparatus having a base attachable to a surface for containing light beam structure therewithin; however, the specific construction is entirely different from that disclosed in the present application.

The patent to Steele, et al., U.S. Pat. No. 3,825,916, shows another line-of-sight light beam utilizing infrared energy generated from a solid state source. Again, this device is used to form a fence for protecting or detecting intrusion of a predetermined area. The structure again is entirely different from that of the present invention.

U.S. Pat. No. 4,004,805 to Chen, et al. discloses the use of double beam laser apparatus for defining the service lines and boundaries of tennis courts for monitoring the tennis ball and the players during the playing of a game. While specific electronic circuitry is disclosed, nothing relating to use of such apparatus for protection on a roof is taught.

U.S. Pat. No. 4,186,388 to Robinson shows a proximity detector utilizing specific elevatable tripod structures, as best seen in FIG. 1 of the patent. While this structure is somewhat related to that disclosed by the present invention, there are substantial differences thereover.

The patent to Tullis, et al., U.S. Pat. No. 4,408,195, discloses the use of a laser transmitter for emitting a beam which can be scanned about a scanning axis to effect a curtain of light which defines a boundary of a working space. If the outboard portion of a crane or other construction equipment moves into the light curtain, appropriate warning signals to the operator and nearby personnel are effected. Again, the structure disclosed in this patent is substantially different from that of the present invention.

None of the known prior art devices and systems offer the new and novel features of the present invention.

SUMMARY OF THE INVENTION

An object of the present invention is to provide a roof perimeter protection apparatus including apparatus for generating and detecting an invisible light beam together with specific structure for fixing the light beam equipment to a roof or other related area.

A further object of the present invention is to provide a warning device for workmen constructing or repairing a building roof which will adequately warn them when they near the dangerous edge thereof so that any fall or other accident will be prevented.

Another object is to provide a simple and yet efficient roof safety device using light beams, preferably invisible beams, together with clamping structure for quickly and easily positioning and holding the equipment on the roof, but which can be just as quickly and easily removed and detached therefrom.

The present invention has a number of new and novel features. The device of the present invention utilizes invisible beams of light for forming a protective fence fairly close to the edge perimeter of a roof. Thus, workmen repairing or constructing such a roof can be quite adequately protected whenever they reach the dangerous edge thereof. Such workman, upon breaking a beam of light of the perimeter fence, is either warned by a bell, a siren, or other sounding device for notifying him that he is in close proximity to either the edge of the roof and/or an unfinished area thereof.

The safety light shoots an invisible generally horizontal light beam for approximately 1,000 feet. The beam of light can be at a zero to four foot elevation from the top of the roof surface. This light beam, when broken by a workman passing any part of his body through the light beam, will activate a loud sounding device for reminding the workman of the roof edge, and/or a danger area. Also, the sounding device can be set for a five second periodic actuation for alerting other roof workmen of the roof edge.

The safety light is not in the workman's way while placing roof material, yet it constantly guards the workman while he is working, and his concentration can be fully on placing roof material and not on his safety. Roof accidents or falls generally are caused by workmen momentarily forgetting the potential danger of falling. However, the present safety device constantly reminds the workman and subconsciously he avoids unsafe movement which would ring the warning bell, which develops a safe workman.

The safety device of the present invention is quickly set up and easy to adjust and can be used with job site temporary power or it can be battery-operated. The safety light is waterproof and totally safe to operate.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIGS. 6A and 6B show the non-electrical component elements together with a container for packaging as a safety kit.

DESCRIPTION OF THE PREFERRED EMBODIMENT(S)

Figure 1:
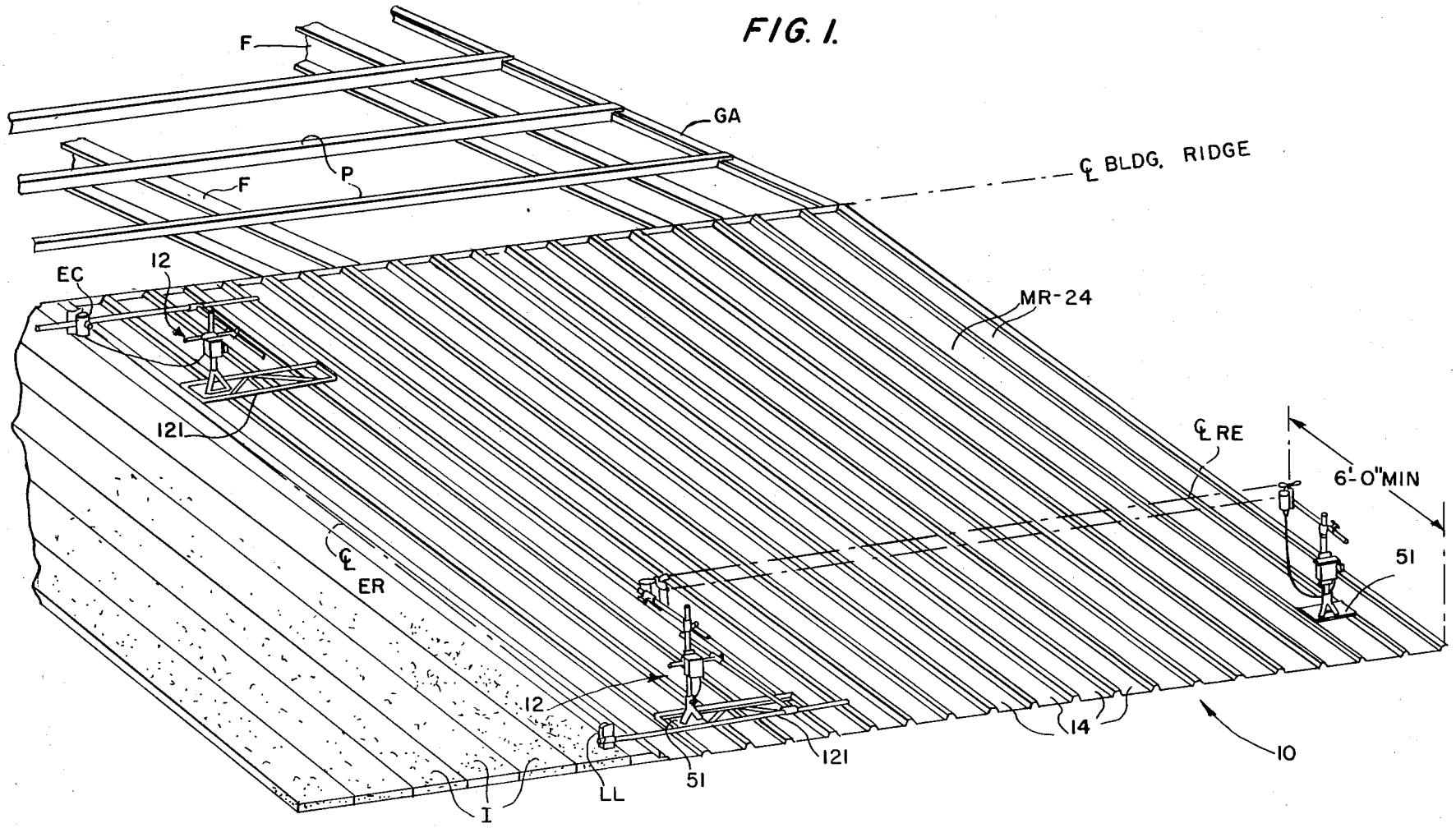
FIG. 1 is a perspective view of the apparatus of the present invention as in use on top of a roof under construction.

Referring to FIG. 1 of the drawing, reference numeral 10 indicates in general the safety apparatus of the present invention. The purpose of this apparatus is to provide at least one beam of light along a dangerous edge of a roof during construction or repair thereof. Preferably, a plurality of devices 12 are used so that two or more beams of light cover all of the dangerous edges of the roof. For example, the building ridge line at the center top portion of the building, the edge lines at the beginning and working ends of the roof, and the open eave portion of the roof. In FIG. 1, the eave portion is shown being protected by a light beam along center line RE, and the open end of the roof panels being installed as shown as being protected by another beam of light along center line ER. The beams of light are preferably invisible, however, upon a workman cutting or breaking same, a loud audio warning device, such as a bell, a buzzer, a siren, or the like, will be actuated, either continuously or intermittently to warn the workman cutting the beam as well as any others that he or she is dangerously close to a roof edge perimeter.

Figures 2, 3:
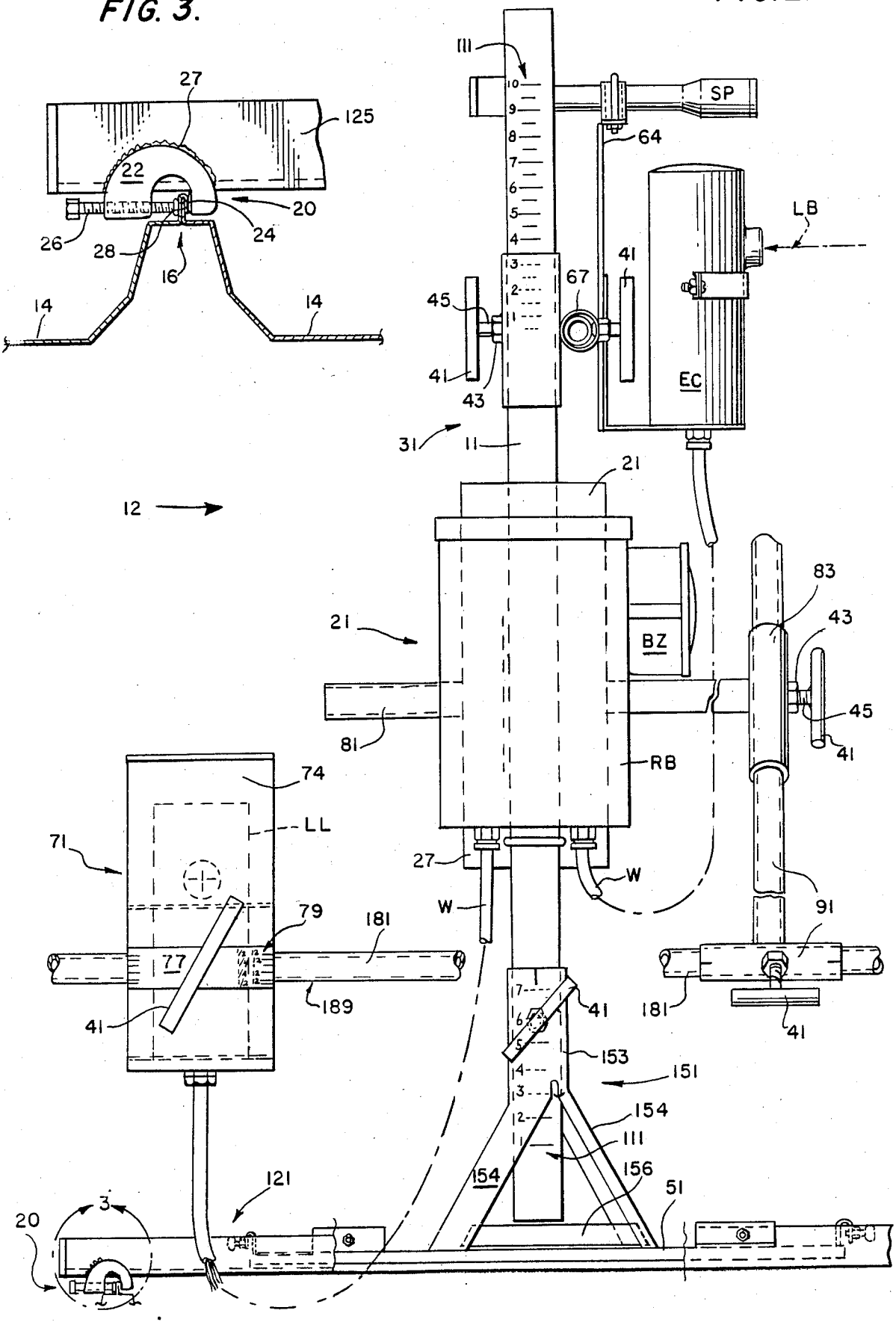
FIG. 2 is an elevational view of the adjustable supporting structure of the present invention.
FIG. 3 is an elevational view of a fragmentary end portion in enlarged detail of the encircled area 3 of FIG. 2 showing the clamping device for roof seam attachment of the support frame.
Figure 4:
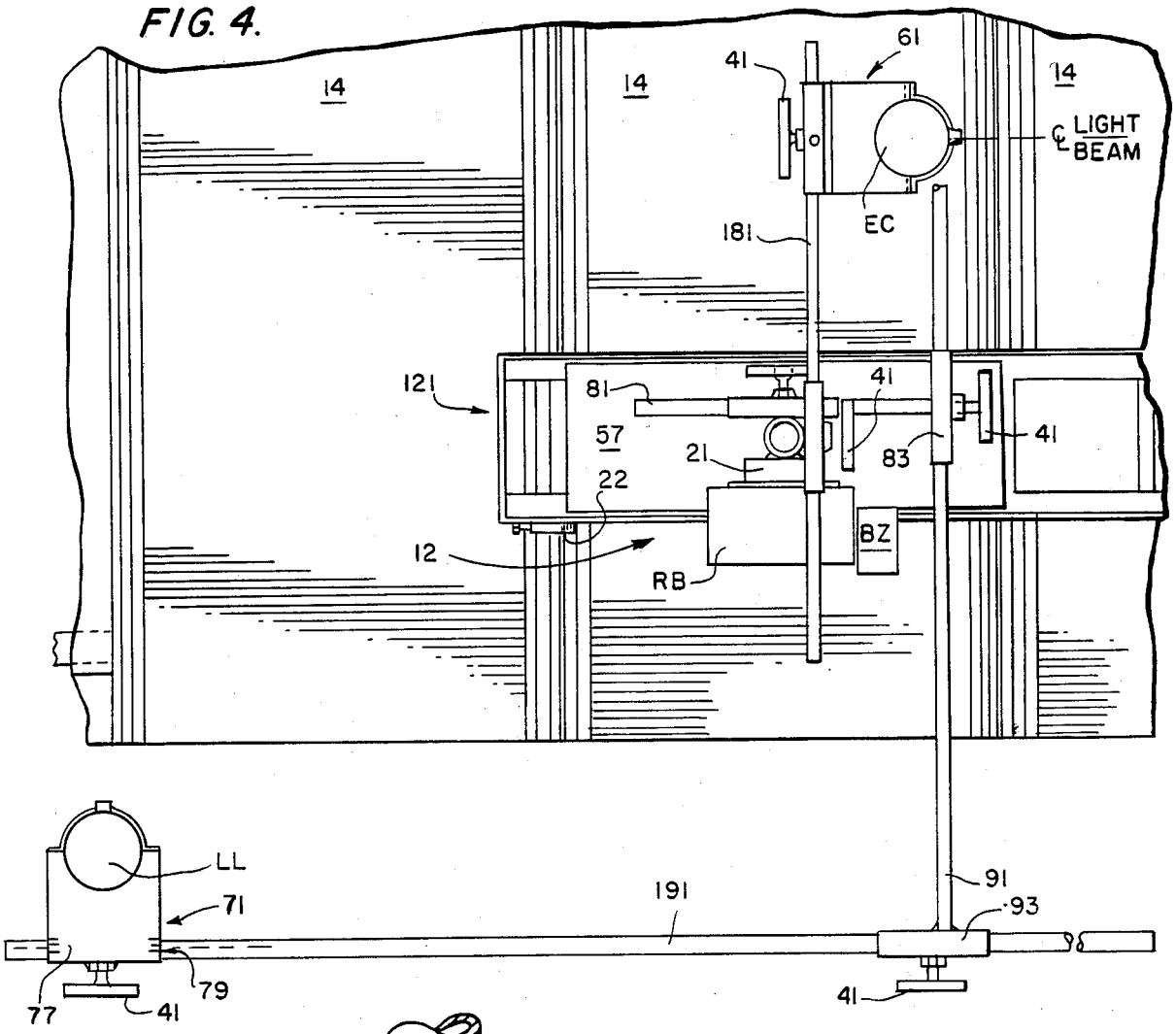
FIG. 4 is a top plan view of the apparatus of FIG. 2.

Looking in general at FIG. 1, as well as FIGS. 2 and 4, the basic assembly of the present invention will be described. An elongated support frame 121 has roof seam clamping structure 20 permanently affixed thereto for securing the frame over the top of roof panels as already assembled on a building during construction thereof. As best seen in detail in FIG. 3, the roof panels 14, preferably Butler MR-24, are securely fastened together by a double lock seam 16. Roof purlins P mounted upon the main roof rafters F support the roof panels 14. Gable ends GA enclose the ends of the plurality of purlins. Insulation I is preferably installed over the purlins before the roof panels are fastened thereto. This construction is typical of that already described in previous patents to the same assignee as the present invention. A C-clamp 22 is affixed permanently by welding 27 or the like to one end of the elongated support frame 121. C-clamp structure 22 is provided with a fixed face 24 and an adjustable face 28 on the end of clamping screw 26 for removably attaching the clamp and frame to a folded seam between adjacent roof panels.

Once the support frame 121 has been attached on top of a roof, a sub-base 51 can be mounted therewithin. Upon the sub-base 51 is mounted a support tripod 151. The support tripod 151 has a central hub 153 and three legs 154 with leg braces 156 affixed thereto. A central support pipe 11 is slid vertically through hub 153 of the support tripod and clamped in a desired position therein by a T-bolt 41.

Vertically adjustably mounted on pipe 11 is a relay box and bracket 21, and a cross coupling 31 for supporting the pipe structure for holding an electronic control/receiver EC. As can be easily visualized, the electronic control/receiver EC can be accurately adjusted on the upper end of pipe 11 by use of the inscribed indicia 111 thereon. Likewise, the other structures can be similarly adjusted to a precise degree.

Now the component elements will be described in detail. These elements are listed in the following table, together with the minimum number required in each kit and the reference number thereof as depicted on the drawing figures.

TABLE OF COMPONENT ELEMENTS FOR SAFETY KIT

| Drawing Reference Number | Minimum Number Required |
|---|---|
| 11 - Steel Pipe, 48" long, 2" outside diameter | 1 |
| 21 - Relay Box (RB) Bracket Plate | 1 |
| 31 - Cross-pipe Clamp, 6" × 6", 2½" internal diameter | 2 |
| 41 - T-handle Clamping Screw | 7 |
| 51 - Support Base | 1 |
| 61 - Electronic Control Receiver (EC) Bracket | 1 |
| 71 - Light Source (LL) Roof Slope Bracket | 1 |
| 81 - 24" T-pipe, Twelve 1" markings | 1 |
| 91 - 96" T-pipe, Center line markings | 1 |
| 191 - 96" T-pipe, both 0 to 48 1" markings and center line markings | 1 |
| 181 - 72" straight pipe, both 0 to 48 1" markings and center line markings | 1 |
| 121 - Support Frame and Track, 1½" × 1½" × 75" angle iron ⅛" × 1½ reinforcing strips | 1 |
| 135 - Container for above non-electronic Kit Elements | 1 |
| RB - Relay Box (RB) with audio bell/buzzer | 1 |
| SP - Spotting Scope | 1 |

-continued

TABLE OF COMPONENT ELEMENTS FOR SAFETY KIT

| Drawing Reference Number | Minimum Number Required |
|---|---|
| LL - Type 42RLR Receiver/Control | 1 |
| EC - Type 42RLL LED Light Source | 1 |
| IP - Insulating Packing for Electronic Components | as needed |
| 235 - Container for Electronic Components | 1 |

FIGS. 6A and B, and 7, show the above-listed component elements in specific detail. Looking at FIG. 6A, the support pipe 11 having adjusting indicia 111 and 211 inscribed therein at each end thereof is shown. The indicia markings 111 begin 2" from one end and include seven markings spaced at 1" increments. At the other end of pipe 11, ten 1" spaced increments 211 are depicted spaced 2" from this end. These markings 111 and 211 as spaced are found to be very useful in the actual assembly, adjustment and use of the apparatus of the present invention. The center line markings 311 are also shown. The preferred length of this pipe is 48".

The next component element shown in FIG. 6A is the bracket plate 21 for holding the relay box RB. The rectangular plate 27 is preferably 6" wide by 15" high. L-Brackets 22, which may be short angle iron sections 2"×2" by 4" long, are appropriately secured by welding 26 to one face of bracket plate 27. Holes 28 are provided for receiving U-clamps 227 therethrough. Adjusting nuts 228 are mounted on end threads 229 of the U-clamps for securing the bracket plate 27 to support pipe 11. Suitable apertures (not shown) are provided in plate 27 for attachment of relay box RB thereto as appropriate for whatever mounting openings are provided on the relay box used. This can vary from box to box so is a variable. However, a plurality of predrilled apertures 128 may be initially provided in the plate, if desired.

The next component of the present invention is a cross-pipe clamp 31. This clamp is preferably two 6" long pipes 33 and 34 welded (36) together at right angles to each other. Threaded nuts 35 are also secured by welding 36 to opposite outsides of the cross-pipes and appropriate apertures lead in to the respective interiors of the pipes for reception of T-clamps 41 therethrough. Pipes 33 and 34 preferably have an internal diameter of at least 2½" so the slidable and adjustable support pipe elements of the kit can easily be slid therethrough and clamped as appropriate.

A plurality of T-handle clamping screws 41 are required. Each clamping screw has a handle 42 together with a stem portion 43 which open end is externally threaded 45. All of the clamp nuts 35, 65, etc. have internal threads which complement and mate with the external threads 45 of these T-handle clamping screws.

The next component element is the support base 51 comprising a rectangular plate 57. The plate 57 is preferably 8" wide by 23½" long. At each respective corner of the plate, clamp structures 53 are suitably attached by welding 56. Each clamp structure 53 is provided with a threaded hex nut 55 receiving a threaded wing nut 59 adjustably therethrough. Thus, as can be easily visualized, the sub-base 57 can be mounted within the main support frame 121 and clamped thereto as appropriate by the clamp structures 53.

Shown adjacent to sub-base 51 is the main support tripod 151. This tripod has a central hub 153 and three legs 154 supporting same. The lower ends of the legs 154 are retained in position by supports 156 appropriately welded thereto. A threaded nut 155 is welded to the outside of hub 153 and aligned with a suitable aperture therethrough for reception of a T-handle clamp screw 41. It is by this structure, which is appropriately affixed to sub-base 51, that the vertical support pipe 11 is supported upon a roof during use of the safety light apparatus of the present invention.

Element 61 in FIG. 6A is the bracket for the electronic control/receiver EC. This bracket comprises a rectangular plate 64 which is approximately 6" wide by 12" high. Along the top of the bracket is an angle member 62 attached by welding or the like and having holes 68 therethrough for receiving the ends of another U-bolt 227 for mounting a spotting scope SP on the bracket 64. Across the lower third of bracket plate 64 is mounted tubular section 67 by welding 66. Another internally threaded nut 65 is welded to tube 67 for receiving a T-clamp screw 41. Holes 68 are provided as indicated for mounting both the spotting scope as well as the electronic control/receiver.

Now looking at FIG. 6B, reference numeral 71 indicates another bracket for supporting a light beam source LL. This bracket 71 is of very similar construction to bracket 61; however, the short tubular portion 77 has markings 79 at at least one end thereof for indicating different roof slopes when adjusting the light beam receiver for eave to ridge safety line protection. The bracket plate 74 is preferably 6" by 12", has an angle support 72 thereon and holes 78 therein for attachment of the light source LL and accessories, as desired. That is, a spotting scope may be attached to bracket 72 like the one described for bracket 62 of the electronic control/receiver bracket 64, or, if desired, the scope can be omitted for the light source LL as attached to bracket 74. It should be noted that the spotting scopes described aid in quick initial adjustment of the electronic control/receiver and the light source LL transmitter, but are not absolutely necessary, since the light units themselves have LED indicators therewith for aid in aligning the light beam source with the light beam receiver.

The next three elements depicted in FIG. 6B are the T-pipes 81, 91 and 191, as well as the straight pipe 181. T-pipe 81 is of 1" outer diameter and 2' long. Twelve 1" markings 87 are pre-inscribed at the end of the pipe opposite to the T-handle. The T-handle 83 is welded to the pipe at 86 and is also provided with a clamp screw nut 85 for receiving one of the T-handle screws 41 therewith. Pipe 91 is also of 1" outside diameter, but is 96" long and only has center line markings 99 inscribed therealong. A T-handle 93 and clamp nut 95 are appropriately fastened by welding 96 to one end of this pipe. The pipe 191 is also 96" long and 1" outer diameter, but has both center line markings 199 therealong and also forty-eight 1" markings spaced from the free end thereof. A T-handle 193 and clamp screw nut 195 are welded thereto by welding 196. The fourth support pipe 191 omits any T member and is only 6' long. Appropriate 1" markings from 0 to 48" are inscribed as indicated by reference numeral 187 and center line markings 189 are also provided. At least one of each of these pipes should be supplied with each kit for same to be complete. A container 135 is shown having flaps 136 and 138 thereon with the other end (not shown) being suitable closed. This container is of sufficient size to contain all of the above-described non-electronic component elements.

Another important element for the kit is the base frame 121. This frame 121 is constructed of suitable angle iron and is approximately 9" wide by 75¼" long. The pair of lengthwise angle irons 125 are suitable welded to two crosswise angle irons 123 to form a rectangular open box-like frame. Additional reinforcing members, 127, 129 are affixed by welding to the underside of this box-like frame. The center element 127 is parallel to the cross-members 123 and perpendicular to lengthwise members 125. The other two elements 129 are at 45° to these members. These members not only function as reinforcing straps, but also are usable as tracks for providing easy adjustment of the support frame on a roof by providing guiding movement of the stand up and down roof eave line. As can be seen by looking at FIG. 1, by aligning one of the tracks 127, 129 with the rolled standing seam between roof panel joints, the support frame can be accurately aligned and guided up, down and sideways of the roof prior to adjustment and clamping of the C-clamp member 22. The kit container 135 is preferably large enough to also contain the frame support 121 along with the other non-electronic components.

Figure 7:
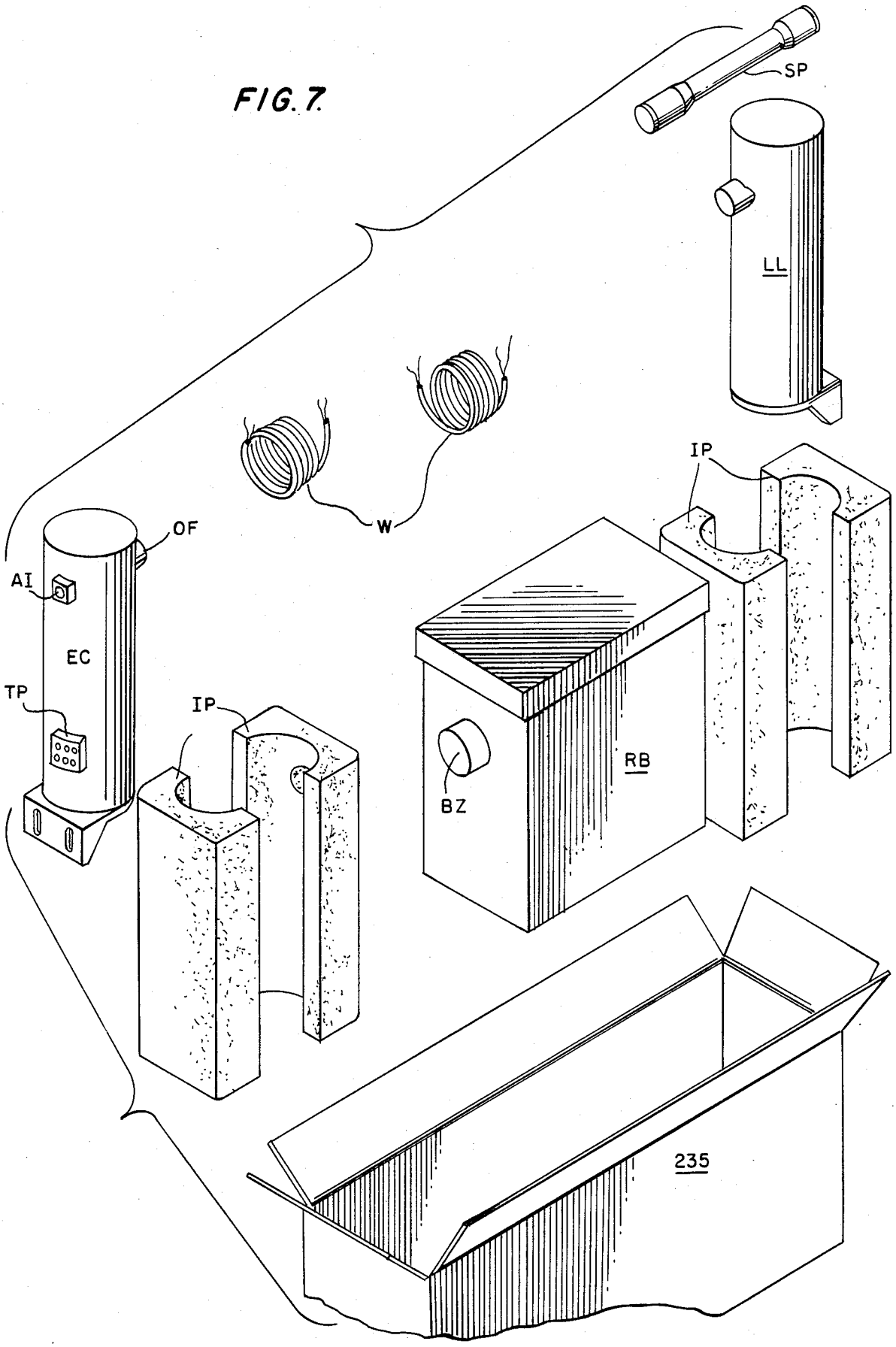
FIG. 7 is a perspective view of a spotting scope, a long range light beam source, a light beam electronic control/receiver, and a relay box with audio warning mechanism.

FIG. 7 shows the electrical and electronic elements of the present invention. These elements include a pulsed LED light source LL and a photodetector receiver/controller EC. The preferred LED wavelength is 940 nanometers. These photoswitch devices preferably are the ones as manufactured by the Photoswitch Division of the Electronics Corporation of America, of Cambridge, Mass. Units which have been found quite suitable for use with this invention are the Type 42RLL Light Source and the Type 42RLR Receiver/Control.

FIG. 7 also shows the relay box RB with audio warning device BZ associated therewith, and a typical type spotting scope SP. The spotting scope may be one like that used by hunters on their rifles. The relay box RB contains either an electrical/mechanical relay, or a solid state switching circuit, and preferably has a sensitivity adjustment associated therewith for varying the amount of voltage necessary for the relay and/or switching circuit to be actuated. Upon actuation thereof, a buzzer BZ, bell, siren, or other audio warning device is actuated. A timer and periodic actuator may also be incorporated in the relay box so that once the light beam has been broken, a continuous signal will periodically occur until such time as the device is reset, or it can just be a single sounding alarm which will cease upon resumption of the light beam.

While the electronic units depicted in FIG. 7 of the drawings can be enclosed together with the non-electronic component elements in container 135, as depicted in FIGS. 6A and B, preferably, since these electronic components are somewhat more fragile, they will be separately packed and shipped and stored with insulating protectors IP in a shock resistant container 235. If desired, the container 235 can be arranged and sized so that it can be included within container 135; however, in many applications, it would simply be easier to have two separate packages.

The Type 42RLL pulsed LED source and the Type 42RLR receiver/control permit long-range operation and/or high-penetration in dirty environment applications. This combination will generally operate at distances of 900 to 1,000 feet where the physical air environment is relatively clean. Of course, under dirty air conditions, the operating length is reduced. The light source operates on either line or battery voltage, and includes the pulser circuitry necessary to transmit an LED beam at a frequency matched to the receiver/control. A visible LED indicator on the light source signifies that it is operative. The receiver/control also operates on either line voltage or battery voltage and includes a detector circuit which is tuned to receive only the LED beam from the source LL. In order to obtain maximum freedom from interfering sources of pulsed illumination, such as fluorescent or mercury vapor lamps, a narrow-band optical filter OF is provided in front of the receiver/control photodetector. A visible LED alignment indicator AI is also mounted on the receiver/control, which can be easily viewed without removing the outside cover of the unit. The indicator AI is for the purpose of simplifying alignment of the two units in relation to each other, and can also be used to determine if the receiver/control unit is functioning properly. In addition, test points TP are provided with external contacts to the internal circuit board for alignment of the receiver/control EC by use of a voltmeter.

Alignment of the LED receiver/control unit with the invisible beam from the LL light source can be accomplished by visually sighting the receiver/control unit at the source unit1 the visible LED indicator on the cover thereof lights up. In order to insure that the beam is centered on the light source, it is desirable to sweep the beam across the source in the horizontal plane and determine at what points the indicator light goes on and then goes off. The receiver/control then should be set approximately half way between the two points. This same procedure is then repeated in the vertical plane. Thereafter, the receiver/control is properly aligned with the light source. Of course, a voltmeter can be used for detecting maximum deflection which is an indication of proper alignment with the light beam. Preferably, both units LL and EC are hermetically sealed and, except for the case of actual physical damage, such as dropping off the roof, etc., neither unit should ever need replacement or maintenance.

Looking again at FIGS. 1, 2, 4 and 5, the mounting of the components of one complete kit will be described. The base frame 121 will be appropriately mounted on the roof edge as shown in the lower central portion of FIG. 1. The sub-base 51 will then be positioned within the base frame 121 and clamped as appropriate thereto. Then the tripod mount 151 will be affixed to the sub-base plate 57. Then, the center post pipe 11 is mounted within the central hub 153 of the tripod. Thereafter, the relay box RB is suitably attached to the bracket plate 21, which is then mounted on vertical post 11 and secured thereto by the U-bolts 227. Next, one of the cross-clamps 31 is mounted upon the post 11 and clamped thereto by a T-screw 41. The remaining open cross-clamp tube then is fitted with a 24" T-pipe 81 for supporting the further T-pipe 91, which in turn supports pipe 191. One end of pipe 191 receives the roof slope bracket 71 thereon. This bracket 71 has suitably affixed to the plate 74 a light source LL. The slope markings 79 on the bracket pipe 77 in conjunction with the center line spacer markings 189 of pipe 181 can be used to adjust the light source to approximately the correct angle as determined by the design pitch or slope of the roof.

Figure 5:
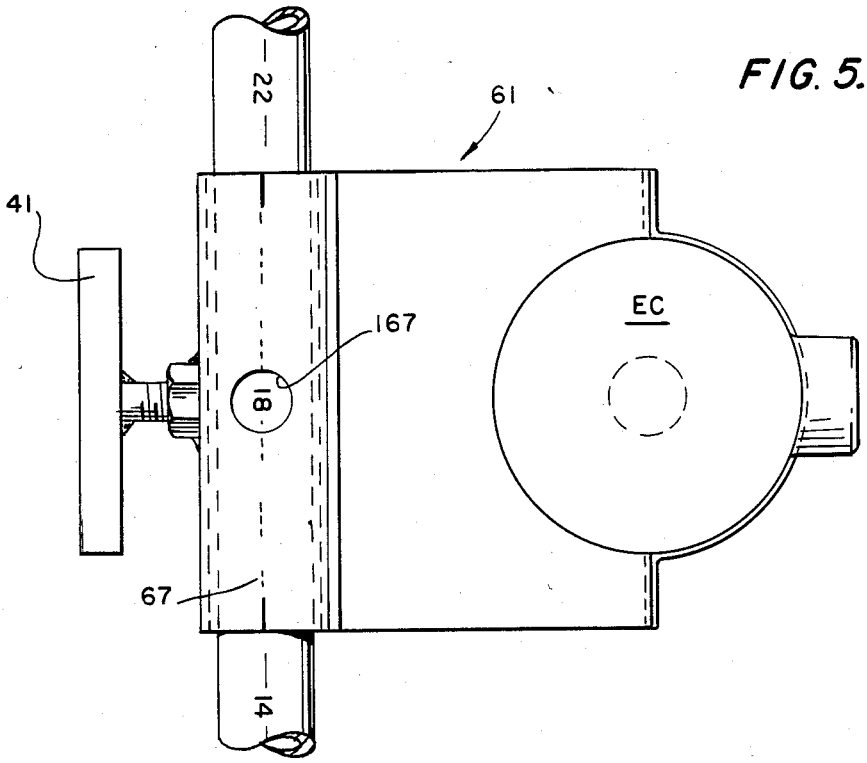
FIG. 5 is a top plan view in enlarged detail of the adjustable mounting for the light beam electronic control receiver.

After the preceding components have been assembled, another double clamp 31 is mounted upon vertical pipe 11 and the remaining open tube receives a second pipe 181 therethrough. On the end of pipe 181 towards the roof ridge, a receiver/control bracket 61 is mounted and clamped. A receiver/control EC has prior to this been appropriately assembled to the bracket plate 64. A scope SP has also already been assembled, or, if preferred, can be assembled by another U-bolt 227 after the installation of the receiver/control unit and bracket. As best seen in FIG. 5, an aperture provided near the center portion of the double clamp structure permits easy viewing of the 1" markers 187 as appropriately spaced along pipe 181. In FIG. 5 the 18th inch marker is clearly visible.

As indicated in FIG. 1, for maximum safety a minimum of six feet from the roof edge to the light beam should be provided. By using the marking indicia on the assembled pipe and clamp structures, it is easy to quickly and accurately adjust each of the light beams this desired minimum distance. Then the beams can be fine tuned and aligned by using the scopes SP as well as the LED indicators associated with the respective receiver/control units EC.

In summary, the present safety protection apparatus is very efficient and very workable. The provision of all the necessary elements in kit form is another advantage of the invention disclosed herein.

The safety light is supported by a lightweight durable structural support, movable and adjustable in feet and inches to easily follow the workman while placing roof panels and insulation on the building structural system. The safety light is so designed to keep constant surveillance for all of the workmen on the roof.

The safety light system works in the following manner:

A. The safety light system has a sender unit which sends a light beam for about 1,000 feet. This beam is picked up by a receiver which has the capability of being easily adjusted and aligned into a straight path with the light beam which allows a very quick apparatus setup time.

B. The receiver unit is wired to a relay switch and a timer which is wired to a loud bell or other sounding alarm. When a workman crosses or breaks the light beam, it will activate the bell alerting the workman that he is entering the danger area of the roof. This develops confidence in the workman because he knows, while he is concentrating on his work, that he will not accidentally step out too far on the edge of the roof area, and thus it will increase his productivity.

C. This safety light system guards the roof workman:
1. on the eave line of the building;
2. on the roof edge in the direction that the roof panels and insulation are placed (roof-working edge); and
3. on the roof ridge line.

This safety light system is now being used by the Construction Division (BUCON) of Butler Manufacturing Company with great success.

This safety light is operated on normal household electric current or battery power if regular power is not available at any time on a construction project. This safety light works very efficiently and will save roof workmen's lives.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

I claim:

1. A safety device for protecting workmen while construction and/or repairing a roof comprising:
a base support means;
a beam generating/transmitting means;
a light beam receiving/control means;
audible warning means connected to said receiving-/control means for actuation thereby;
adjustable means for supporting both said light beam generating/transmitting means and said receiving-/control means on said base support means, wherein said adjustable means for securely attaching said light beam transmitting/receiving means to said support means includes a plurality of elongated pipes, each of said pipes being mounted in a clamp fixture which permits slidability thereof, and adjustable clamp means for fixing said pipe at a desired position in said clamp structure,
roof clamping means for removably attaching said base support means on a roof, said clamping means including a C-clamp having one fixed edge and one adjustable member for clamping said structure to a locking seam between adjacent roof panels.

2. The safety device defined in claim 1, wherein said adjustable clamp means includes a T-bolt having a threaded stem, said threaded stem passing through a threaded aperture in each pipe receiving portion of said clamping structure.

3. The safety device defined in claim 2, wherein said clamp structure includes a pair of short tubular portions integrally affixed to each other at substantially right angles to each other.

4. The safety device defined in claim 1, wherein said clamping means for removably holding said base support means on a roof includes an elongated support plate having angle iron side elements, a criss-cross strengthening center structure, and said C-clamp is affixed to said plate for attaching same to a roof structure.

5. A safety device for protecting workmen while constructing and/or repairing a roof comprising:
a base support means;
a light beam generating/transmitting means;
a light beam receiving/control means;
audible warning means connected to said receiving-/control means for actuation thereby;
adjustable means for supporting both said light beam generating/transmitting means and said receiving-/control means on said base support means; and
roof clamping means for removably attaching said base support means on a roof, wherein said base support means includes an elongated base plate, a tripod mount thereon, and said adjustable means is mounted upon said tripod mount for both vertical and horizontal movement, wherein said vertically and horizontally adjustable means includes a plurality of cross clamp structures together with slidable members, said slidable members having appropriate marking indicia thereon for accuracy in positioning said light beam means, and said clamping means including a C-clamp having one fixed edge and one adjustable member for clamping said structure to a locking seam between adjacent roof panels.

6. The safety device defined in claim 5, wherein each of said cross-clamp structures include short tubular portions substantially at right angles to each other, and each portion having a clamping T-bolt adjustably mounted therewith.

7. The safety device defined in claim 6, wherein each of said slideably adjustable members includes an elongated pipe of a length much longer than its diameter, and with indicia markings applied on the outer surface thereof.

8. The safety device defined in claim 7, wherein at least one elongated pipe is provided with a scoreline along the centerline thereof for alignment purposes.

9. The safety device defined in claim 5, wherein said light beam transmitting/receiving means includes an electronic control box having suitable electronic circuitry therewithin for generating a beam of light, an exit lens for directing said beam of light along a desired path, and a complementary receiving device for receiving a complementary light beam from another such unit.

10. The safety device defined in claim 9, wherein said beam which is produced is a laser beam.

11. The safety device defined in claim 5, wherein said audible warning means includes a buzzer connected to said light beam transmitting/receiving means.

12. A roof workman safety device apparatus comprising: a kit of component items usable for mounting along the perimeter of a building roof during construction and/or repair thereof to provide an audible warning to a workman whenever he or she comes dangerously close to a roof edge including; a container for the following elements; a support base for mounting upon a roof; an adjustable support tripod attachable to said support base; a plurality elongated pipes, and clamp fixtures for mounting upon said support tripod mounted in a clamp fixture which permits slidability thereof; and adjustable clamp means for fixing said pipe at a desired position in said clamp structure and a pair of light beam transmitting and receiving devices; and roof clamping structure for said support base including a C-clamp having one fixed contact edge and one fixed contact edge and one adjustable contact edge for attaching and clamping same to a rolled seam between adjacent roof panels of said roof.

13. The safety device apparatus as defined in claim 12, wherein said support base includes a rectangular plate, reinforcing angle iron around the perimeter thereof, and center reinforcing rails attached in criss-cross fashion thereto.

14. The safety device apparatus as defined in claim 12, wherein said tripod mount includes a support hub having three diverging mounting legs extending therefrom, said support hub receiving a vertical pipe slidably therethrough, said pipe being provided with marking indicia at at least one end thereof.

15. The safety device apparatus as defined in claim 12, wherein said light beam transmitting/receiving means includes audible warning means mounted on a relay box for actuation as appropriate by said light beam receiving means.

16. The safety device apparatus as defined in claim 13, wherein said roof clamping structure includes a C-clamp having one fixed contact edge and one adjustable contact edge for attaching and clamping same to a rolled seam between adjacent roof panels of said roof.

17. The safety device apparatus as defined in claim 16, wherein said light beam transmitting and receiving means includes audible warning means associated therewith for actuation as appropriate by said light beam receiving means.

18. The safety device apparatus as defined in claim 17, wherein said tripod mount includes a support hub having three diverging mounting legs extending therefrom, said support hub receiving a vertical pipe slidably therethrough, said pipe being provided with marking indicia at at least one end thereof.

* * * * *